US005324213A

United States Patent [19]

Frantz

[11] Patent Number: 5,324,213

[45] Date of Patent: Jun. 28, 1994

[54] BALLAST CONNECTOR

[75] Inventor: Robert H. Frantz, Newville, Pa.

[73] Assignee: The Whitaker Corporation, Wilmington, Del.

[21] Appl. No.: 7,319

[22] Filed: Jan. 21, 1993

[51] Int. Cl.[5] ..... H01R 4/24

[52] U.S. Cl. ..... 439/441

[58] Field of Search ..... 439/436–441

[56] References Cited

U.S. PATENT DOCUMENTS

| | | | |
|---|---|---|---|
| 3,093,433 | 6/1963 | Ege | 439/441 |
| 3,324,447 | 6/1967 | Pistey | 439/441 |
| 4,036,545 | 7/1977 | Mysiak et al. | 439/441 |
| 4,705,482 | 11/1987 | Endo et al. | 439/460 |
| 4,729,740 | 3/1988 | Crowe et al. | 439/76 |
| 4,978,315 | 12/1990 | Edgley et al. | 439/441 |
| 4,981,432 | 1/1991 | Kikuchi | 439/417 |

*Primary Examiner*—Joseph H. McGlynn
*Attorney, Agent, or Firm*—William B. Noll

[57] ABSTRACT

This invention is directed to an electrical connector, particularly a ballast connector for use with fluorescent light fixtures. The connector, offering a means for readily and reliably inserting and extracting discrete wires individually or collectively thereto, comprises (a) a dielectric housing having a plurality of cavities therein extending between a contact loading face and a conductor receiving face, where the conductor receiving face includes an aligned row of conductor openings of a like plurality, and at least one additional opening spaced therefrom in communication with at least one of the cavities, and (b) a stamped electrical contact within each cavity, said contact including a base having a pair of spaced apart arms upstanding therefrom, where the space therebetween is aligned with a corresponding conductor opening and is adapted to receive an electrical conductor therein, said one arm including an appendage therefrom, where said appendage is exposed to said additional opening, whereby an extraction/insertion tool may be inserted into said additional opening to laterally flex the one arm or plural arms to provide a free path for the electrical conductor so as to remove or insert the electrical conductor or conductors between the respective pairs of arms.

7 Claims, 5 Drawing Sheets

BALLAST CONNECTOR

RELATED APPLICATION

The invention hereof is related to the invention covered in U.S. Ser. No. 08,006-888, filed concurrently with this application, now U.S. Pat. No. 5,292,260.

BACKGROUND OF THE INVENTION

This invention is directed to an electrical connector, particularly an electrical ballast connector of the type for use with fluorescent light fixtures, where there is a need to readily and reliably insert or extract electrical conductors therefrom.

Fluorescent electrical ballasts are used in areas where fluorescent lighting is present, and are typically located Within or behind the fluorescent light fixture. Typically, the electrical ballast comprises a long rectangular metal box or "can" with the electrical components mounted inside. A sealer or "potting compound" is then poured into the can which hardens to seal the electrical components within the can. Also typical is to have several discrete wires projecting through the potting material for electrical interconnection thereto. Typically the fluorescent fixture includes complementary discrete wires for interconnection to the discrete wires of the ballast.

The industry which manufactures electrical ballasts has recently begun mounting the components on printed circuit boards to eliminate the discrete wiring within the ballasts. The interior of the ballast is again potted to seal the components within the ballast housing. However, discrete wires still project through the potting for interconnection to the respective discrete wires of the wiring from the lighting fixtures. One such manufacturer has included an electrical connector at the end of the discrete wires for interconnection thereto by a mating electrical connector. The disadvantage to having an electrical connector at the end of the discrete wires is that typically the fluorescent fixtures are not sold with a mating electrical connector. Therefore, the manufacturer of the ballast has to include both connector halves which increases the cost of the electrical ballast. Furthermore, the installer of the ballast must not only replace the ballast but must also terminate the discrete wires of the lighting to the mating half of the electrical connector. When replacing the ballast, the user of the electrical light fixture must buy a ballast which also carries an electrical connector which is matable with the electrical connector of the first ballast installed. Otherwise, the electrical connector on the lighting fixture must also be replaced when the ballast is replaced.

U.S. Pat. No. 4,729,740 represents an improvement to the prior art attempts to achieve a risk free ballast connector and the foregoing problems associated with wiring same. The connector thereof includes a housing for receiving stripped conductors and a terminal mounted therein, where the terminal comprises a flat blade portion having a resilient, angled contact portion extending from one end thereof. The angled contact portion is directed away from the conductor receiving face of the housing so that as the stripped conductor is inserted into the housing the angled contact portion is. biased upward but remains in electrical contact with the terminal. Unfortunately, the design of such connector offers no reliable means by which to extract the conductors from the housing. The present invention provides an easy and reliable means to load the conductors, and to extract same from the connector housing.

The advantages hereof will become apparent in the description which follows, particularly when read in conjunction with the drawings which follow.

SUMMARY OF THE INVENTION

The present invention is directed to an electrical connector of the type that may be used as a ballast connector for fluorescent light fixtures. The connector offers the advantages of a means for readily and reliably connecting or disconnecting discrete wires thereto. The connector comprises a dielectric housing having a plurality of cavities therein extending between a contact loading face and a conductor receiving face, where the conductor receiving face includes an aligned row of conductor openings of a like plurality, and at least one additional opening spaced therefrom in communication with at least one of the cavities. Additionally, a stamped electrical contact is provided within each cavity, where the contact includes a base having a pair of spaced apart arms upstanding therefrom, and that the space between the arms is aligned with a corresponding conductor opening, and is adapted to receive an electrical conductor therein. One of the arms includes an appendage therefrom, where the appendage is exposed to the additional opening, whereby an extraction/insertion tool may be inserted into this additional opening to laterally flex the one arm to provide a free path for the electrical conductor so as to remove or insert the electrical conductor between said arms.

DETAILED DESCRIPTION OF PREFERRED EMBODIMENTS

The present invention relates to an electrical connector, such as may be used as a ballast connector for a lighting fixture, that offers to the installer an easy and reliable means to load or extract conductors therefrom. In the preferred embodiments, the connector housings have been designed to allow individual loading or extraction of the conductors, or to allow loading or extraction of all conductors in a single operation.

Figure 5:
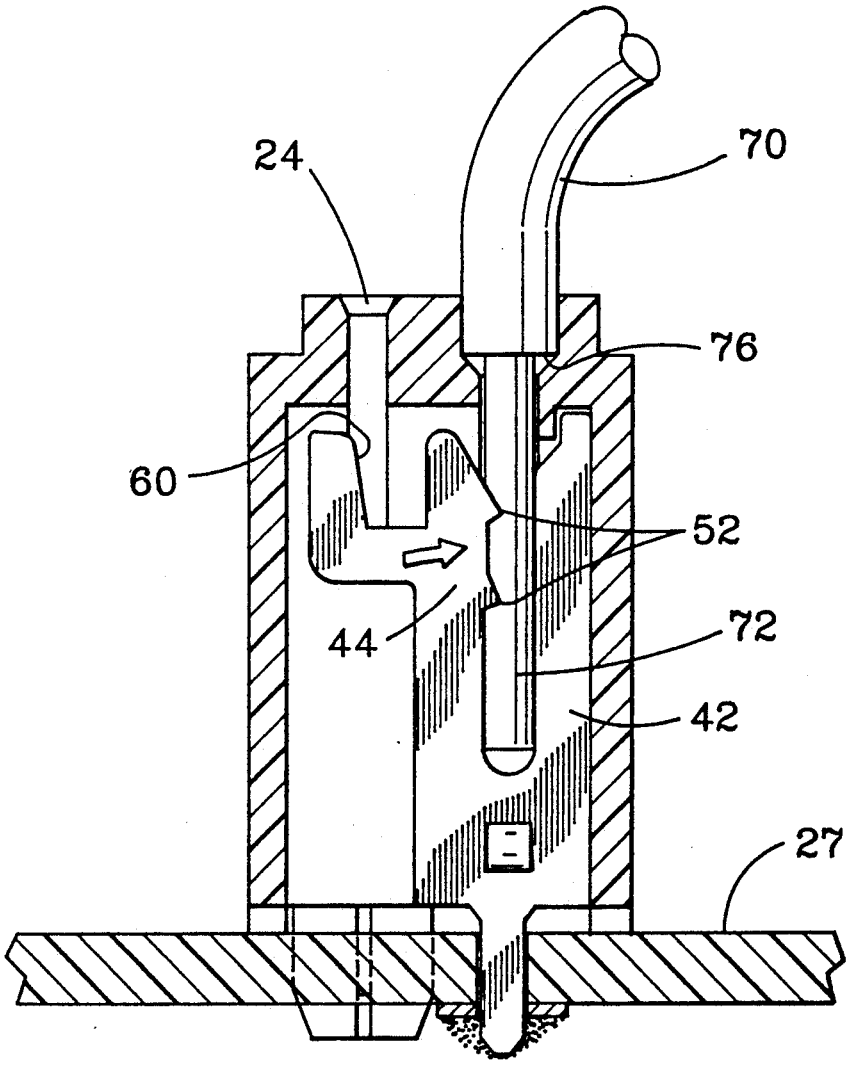
FIG. 5 is a partial sectional view of the assembly of FIG. 1, illustrating the position for inserting a stripped conductor in the connector housing.
Figure 6:
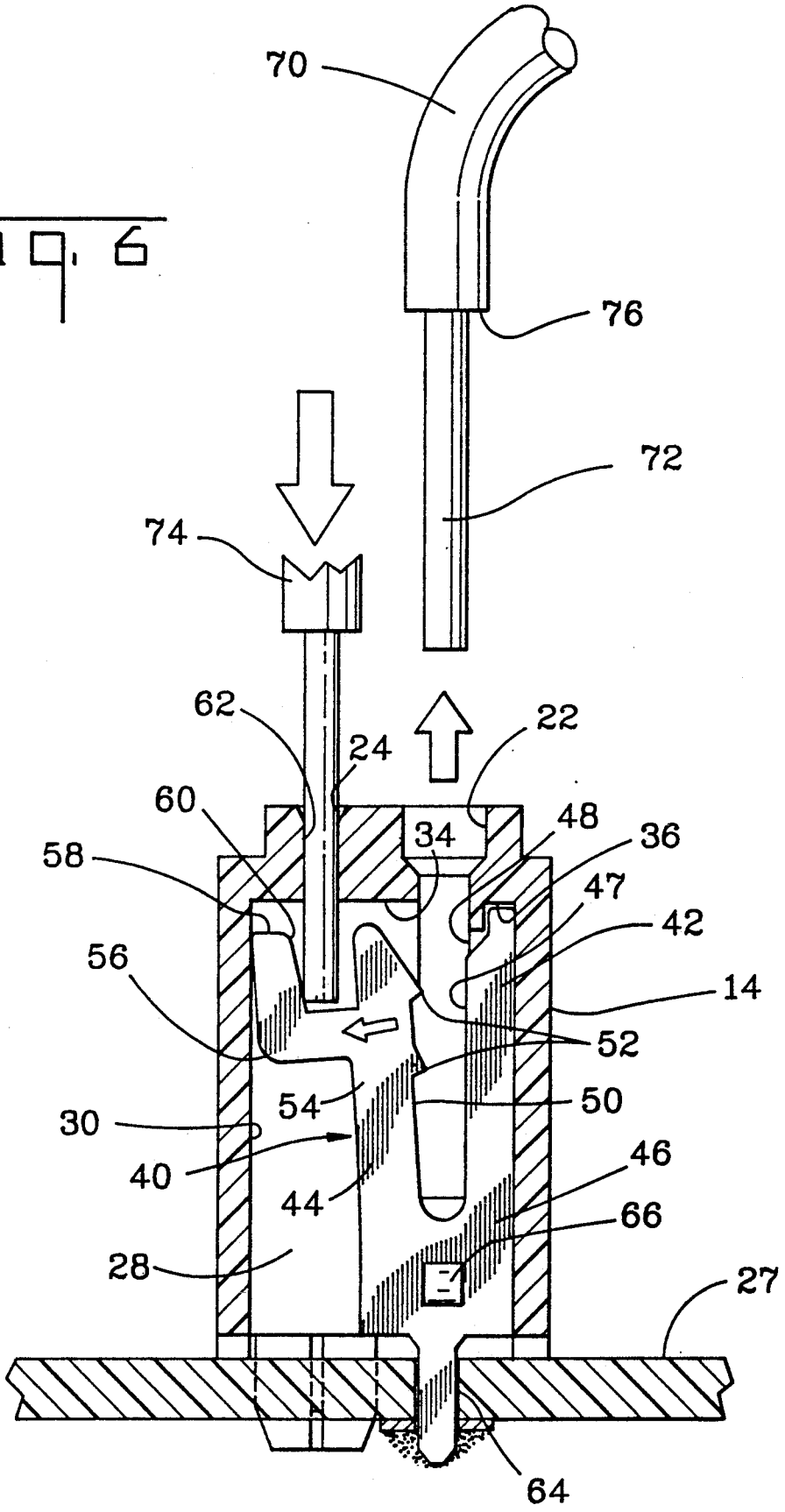
FIG. 6 is a partial sectional view similar to FIG. 5 showing the loaded connector.

FIGS. 1–6 represent the former embodiment. The connector 10 according to the invention comprises a housing 12, molded from a dielectric material, such as plastic, having a pair of side walls 14, a pair of end walls 16, a conductor loading face 18, and a terminal loading face 20. Along the conductor loading face 18 are two rows of aligned pairs of openings 22, 24 which communicate with the interior thereof, as best illustrated in FIGS. 5 and 6. Projecting below from the terminal loading face 20 are a pair of alignment/mounting posts 26 for mounting to a printed circuit board (PCB) 27, as known in the art.

Interiorly, the housing 12 includes a plurality of narrow cavities 28, where the number of cavities is equal to the number of pairs of openings 22, 24, namely, one cavity 28 for each pair of openings 22, 24, aligned therewith. Each cavity 28 is defined by a pair of side walls 30, see FIG. 4, where a recess 32 has been provided in one of the cavity side walls 30. In a manner to be described hereinafter, the recess 32 is adapted to receive a locking lance struck from the body of the terminal. Finally, along the upper wall 34 of the cavity 28, a recess 36 is provided near the opening 22, see FIG. 6.

The electrical terminal 40, illustrated in the loading position in FIG. 6, comprises an essentially planar member stamped from a blank of electrically conductive resilient material, such as metal. The terminal 40 includes a pair of major arms 42, 44 projecting in essentially parallel fashion from a base 46. A first major arm 42 is designed to lie adjacent the inside of side wall 14 and within recess 36, and project toward the opening 22, where the edge 47 essentially coincides with the wall of slot 48 communicating with opening 22.

The second major arm 44 may be slightly angled toward the first major arm 42 in the resiled position, where the inside edge 50 includes a pair of conductor engaging barbs 52. Extending from the opposite edge 54 is an L-shaped arm 56, where the upstanding leg 58 is provided with an angled edge 60. The latter leg 58 is aligned within the slot 62 communicating with opening 24. Finally, projecting downwardly from the terminal base 46 is a PCB engaging leg 64 for interconnection to a PCB 27 by soldering, as known in the art. To secure the terminal within the cavity 28, a locking lance 66 may be struck from the base 46, for seating in recess 32 when the terminal is inserted into the housing cavity.

Figure 1:
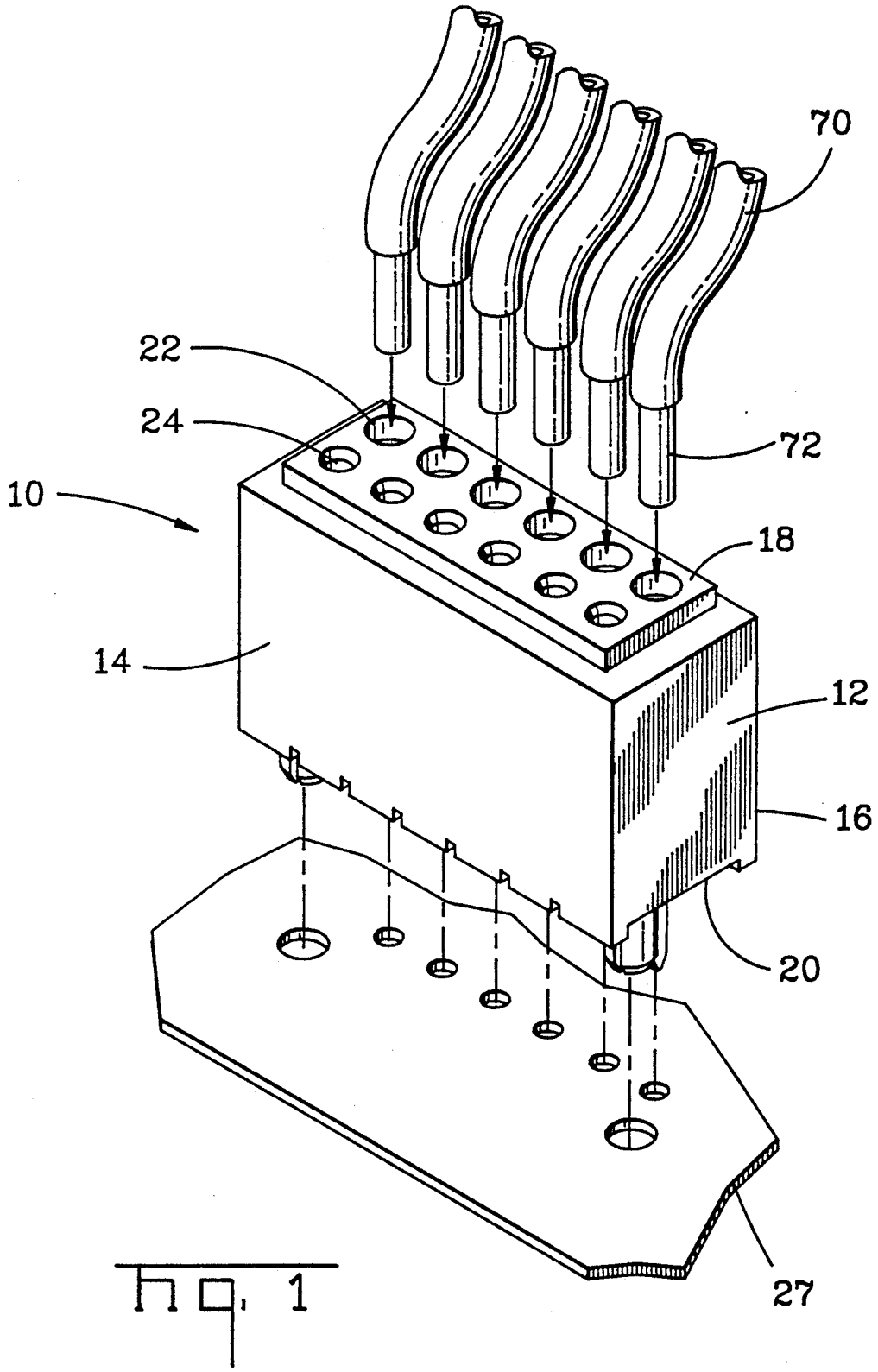
FIG. 1 is a perspective view of a preferred electrical connector according to this invention, showing a portion of a printed circuit board to which it may be mounted, and a plurality of stripped conductors prior to insertion therein, along with a representative tool to effect such insertion.
Figure 2:
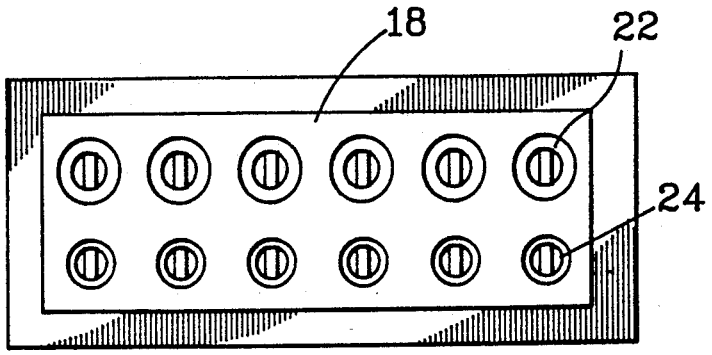
FIG. 2 is a top view of the electrical connector of FIG. 1.
Figure 3:
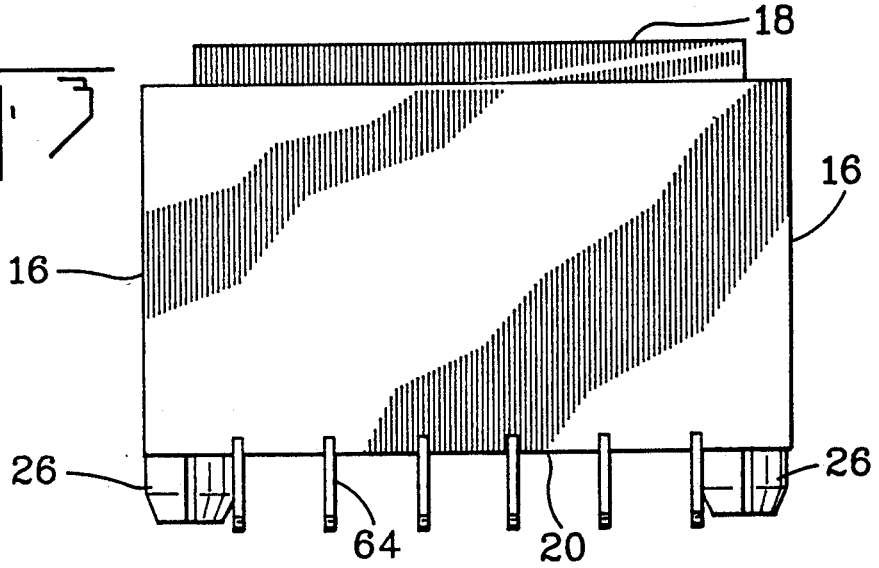
FIG. 3 is a front view of the electrical connector of FIG. 1.
Figure 4:
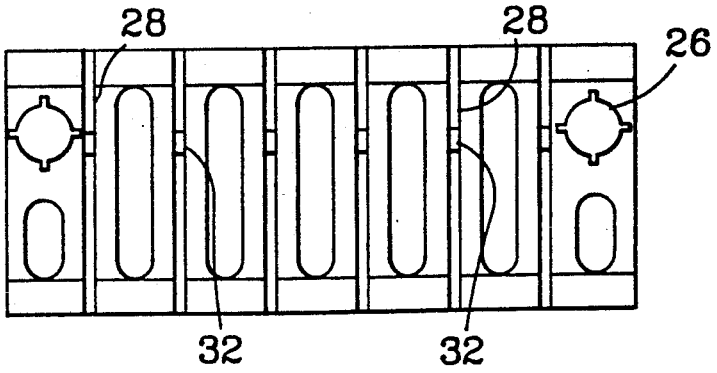
FIG. 4 is a bottom view of the electrical connector of FIG. 1.

To assemble or load the connector, an insulated conductor 70 having the end stripped 72 to expose the core, see FIGS. 1 and 6, is positioned above the opening 22. A tool 74, having a shank of a size to enter into hole 24 and slot 62, where a typical tool 74 is shown in FIG. 6, is inserted into hole 24 to push against angled edge 60 causing L-shaped arm 56 to pivotally move away from the first major arm 42. By this action the barbs 52 essentially recede out of line from the opening 22, see FIG. 5, creating a free path for entry of the bare core 72 into slot 48. The conductor may then be inserted into slot 48 until the insulation shoulder 76 seats within opening 22, at which point the tool 74 is removed whereby the second major arm 44 resiles, see FIG. 5, into a position where the barbs 52 engage and dig into the core 72.

Briefly then, FIG. 5 shows the position prepatory to loading the conductor into the connector, while FIG. 6 shows the position of a loaded connector with the tool 74 withdrawn therefrom.

Figure 7:
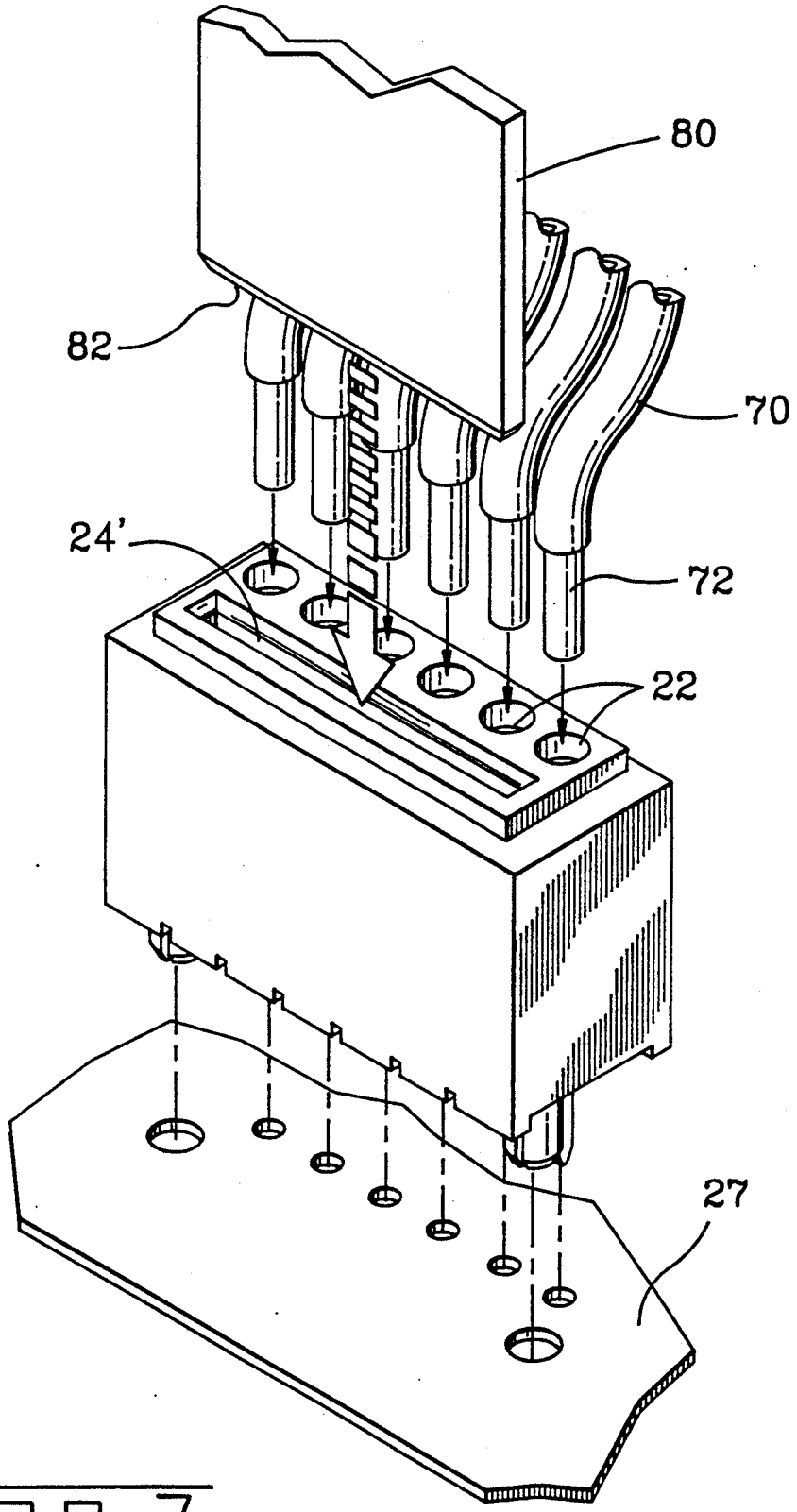
FIG. 7 is a perspective view similar to FIG. 1 showing an alternate preferred embodiment.

In the alternate preferred embodiment of FIG. 7, the opening or elongated slot 24' replaces the plural openings 24 of FIG. 1. By this arrangement, a single, wide blade-type tool 80 may be inserted into the opening 24' to allow insertion and/or extraction of all the conductors in a single operation. That is, the blade 82 acts simultaneously against the angled edges 60 of each terminal causing the arms 56 to shift to allow loading or unloading of all conductors 72 from their respective holes 22 and slots 48.

I claim:

1. An electrical connector providing means for reliably inserting and extracting electrical conductors therefrom, said connector comprising:

(a) a dielectric housing having a plurality of cavities defined by a pair of end walls, said cavities arranged transversely to a longitudinal axis thereof and extending between a contact loading face and a conductor receiving face, where said conductor receiving face includes an aligned row of conductor openings of a like plurality, and at least one additional opening spaced therefrom in communication with at least one of said cavities, and (b) a stamped electrical contact within each said cavity and planarly aligned transverse to said longitudinal axis, said contact including a base having a pair of spaced apart arms upstanding therefrom, where the space therebetween is aligned with a corresponding conductor opening and is adapted to receive an electrical conductor therein, one of said spaced apart arms spaced from a cavity wall and including an appendage therefrom, where said appendage is exposed to said additional opening, and adapted to flex within the plane of said contact toward said cavity wall, whereby an extraction/insertion tool may be inserted into said additional opening to laterally flex said one arm to provide a free path for said electrical conductor so as to remove or insert said electrical conductor between said arms.

2. The electrical connector according to claim 1, wherein said contact includes a solder leg extending from said base through said contact loading face, where said leg is adapted to be mounted to and electrically connected with a printed circuit board.

3. The electrical connector according to claim 1, wherein each said contact includes a lance projecting therefrom, where said lance is adapted to engage the cavity wall to fixedly engage said contact therewithin.

4. The electrical connector according to claim 1, wherein said at least one additional opening is a single slot longitudinally coextensive with said conductor openings.

5. The electrical connector according to claim 1, wherein said at least one additional opening is a like plurality of separate openings, where each additional opening is laterally aligned with one of said conductor openings.

6. The electrical connector according to claim 1, wherein one of said contact arms includes a laterally projecting barb for engagement with an electrical wherein one of said contact arms includes a laterally conductor inserted between said arms.

7. The electrical connector according to claim 1, wherein said appendage comprises an L-shaped arm, where one of the legs thereof includes a camming surface exposed to said additional opening, whereby an extraction/insertion tool may be inserted into said additional opening and caused to ride along said camming surface to thereby laterally move said one arm.

* * * * *

UNITED STATES PATENT AND TRADEMARK OFFICE

CERTIFICATE OF CORRECTION

PATENT NO. : 5,324,213
DATED : June 28, 1994
INVENTOR(S) : Robert H. Frantz

It is certified that error appears in the above-indentified patent and that said Letters Patent is hereby corrected as shown below:

Column 4:

Claim 6, line 57, please delete "wherein one of said contact arms includes a laterally"

Signed and Sealed this

Twentieth Day of September, 1994

Bruce Lehman

*Attest:*

BRUCE LEHMAN

*Attesting Officer*

*Commissioner of Patents and Trademarks*